US006662699B1

(12) United States Patent
Schmidt

(10) Patent No.: US 6,662,699 B1
(45) Date of Patent: Dec. 16, 2003

(54) MITER BOX

(75) Inventor: Sheldon Schmidt, Paramus, NJ (US)

(73) Assignee: Great Neck Saw Manufacturers, Inc., Mineola, NY (US)

( * ) Notice: Subject to any disclaimer, the term of this patent is extended or adjusted under 35 U.S.C. 154(b) by 66 days.

(21) Appl. No.: 10/038,430

(22) Filed: Jan. 7, 2002

(51) Int. Cl.[7] ..... B26D 7/01; B26D 7/26
(52) U.S. Cl. ..... 83/765; 83/468
(58) Field of Search ..... 83/762, 763, 764, 83/765, 468.7, 468; 269/99, 295

(56) References Cited

U.S. PATENT DOCUMENTS

| | | | | | |
|---|---|---|---|---|---|
| 99,398 | A | | 2/1870 | Bullard | |
| 339,455 | A | | 4/1886 | Olmsted | |
| 415,940 | A | | 11/1889 | Davis | |
| 477,233 | A | | 6/1892 | Soukup | |
| 536,936 | A | | 4/1895 | Nicholls | |
| 600,118 | A | | 3/1898 | Bruno | |
| 780,657 | A | | 1/1905 | Holt | |
| 1,013,010 | A | | 12/1911 | Graham | |
| 1,089,761 | A | | 3/1914 | Gladwin | |
| 1,175,811 | A | | 3/1916 | Ray | |
| 3,397,722 | A | | 8/1968 | Long | |
| 3,397,772 | A | * | 8/1968 | Long | 206/783 |
| 3,590,891 | A | | 7/1971 | Gugliemo | |
| 3,842,700 | A | * | 10/1974 | Novak | 83/743 |
| 4,262,571 | A | | 4/1981 | King | |
| 4,300,755 | A | | 11/1981 | Potvin | |
| 4,433,600 | A | * | 2/1984 | Ikeda | 83/468 |
| 4,476,757 | A | * | 10/1984 | Morris | 83/446 |
| 4,712,462 | A | * | 12/1987 | Cvek | 83/762 |
| 4,974,306 | A | * | 12/1990 | Cole et al. | 29/434 |
| 5,121,554 | A | * | 6/1992 | Havins | 33/640 |
| 5,573,230 | A | * | 11/1996 | Lambertini | 269/235 |
| 5,813,306 | A | * | 9/1998 | Jacoff | 83/762 |
| 5,816,300 | A | * | 10/1998 | Rogers | 144/136.95 |
| 5,873,292 | A | * | 2/1999 | Goese | 83/452 |
| 6,393,958 | B1 | * | 5/2002 | Owens et al. | 83/762 |
| 6,530,302 | B1 | * | 3/2003 | Rogers | 83/452 |
| 2002/0029678 | A1 | * | 3/2002 | Erisoty | 83/766 |
| 2002/0035909 | A1 | * | 3/2002 | Poole et al. | 83/451 |

* cited by examiner

*Primary Examiner*—Allan N. Shoap
*Assistant Examiner*—Ghassem Alie
(74) *Attorney, Agent, or Firm*—Joseph J. Previto

(57) ABSTRACT

A miter box having a base and opposed side walls. A one slot in each of the side walls in alignment and coextensive with each other. A channel formed in the base. A holding assembly having a guide extending into the channel and movable along the channel relative one of the side walls. A locking element to lock the holding means at a predetermined position along the channel and at a predetermined space from the side wall.

12 Claims, 4 Drawing Sheets

MITER BOX

BACKGROUND

The present invention relates to mitre boxes and more particularly to a mitre box in which the article being cut can be held steady and in place while being cut.

Mitre boxes have been used for a number of years and are used primarily to cut strips of wood at predetermined angles. It has been found that when pieces of wood are to be cut, it is difficult to hold the piece of wood steady while it is being cut. This sometimes causes the wood to move slightly so that the cut is not made at the desired angle or at the desired place. This problem is particularly troublesome when thin pieces of wood are to be cut. Attempts to correct this drawback have resulted in mitre boxes which are complicated to use and expensive to manufacture and maintain.

OBJECTS

The present invention overcomes these drawbacks and has for one of its objects the provision of an improved mitre box in which a piece of wood can be cut without any danger of the wood moving and being cut at the wrong angle or at the wrong place.

Another object of the present invention is the provision of an improved mitre box in which means are provided for holding the wood steady in place.

Another object of the present invention is the provision of an improved mitre box which is simple to use.

Another object of the present invention is the provision of an improved mitre box which is inexpensive to manufacture and maintain.

Other and further objects of the invention will be obvious upon an understanding of the illustrative embodiment about to be described, or will be indicated in the appended claims and various advantages not referred to herein will occur to one skilled in the art upon employment of the invention in practice.

DRAWINGS

A preferred embodiment of the invention has been chosen for purposes of illustration and description and is shown in the accompanying drawings forming a part of the specification wherein.

DESCRIPTION

Figure 1:
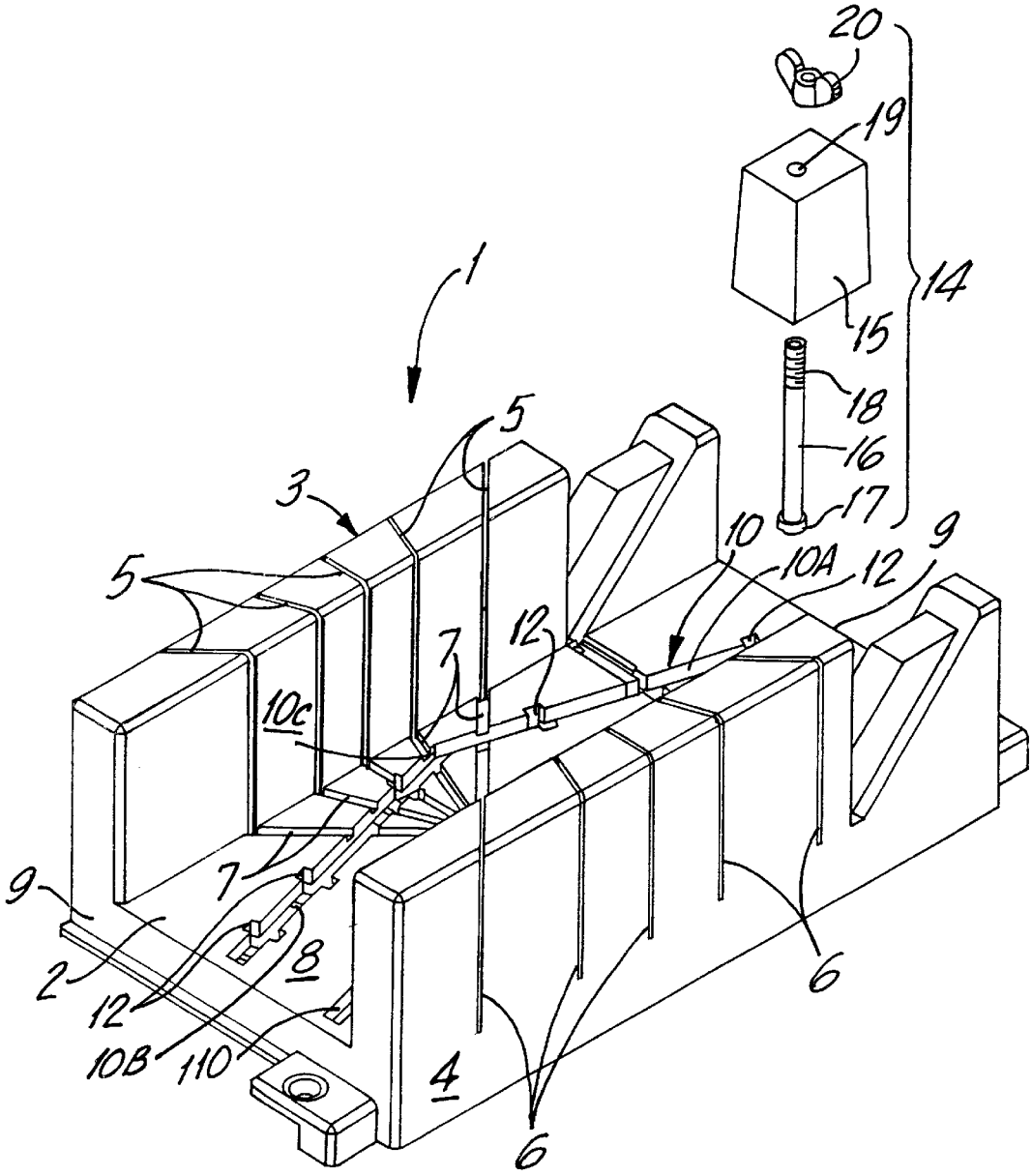
FIG. 1 is a perspective view showing a mitre box made in accordance with the present invention.
Figure 2:
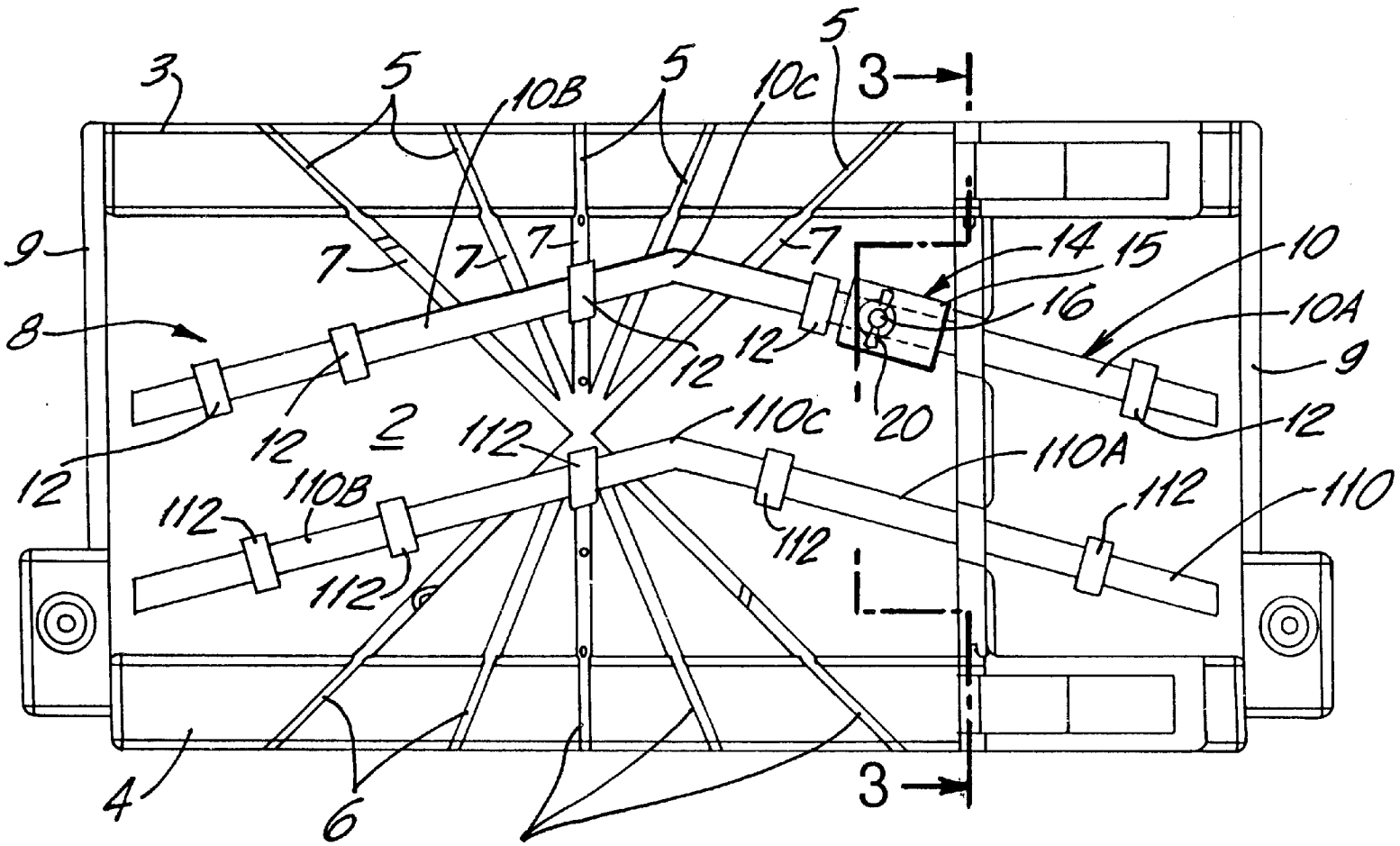
FIG. 2 is a top plan view thereof.
Figure 5:
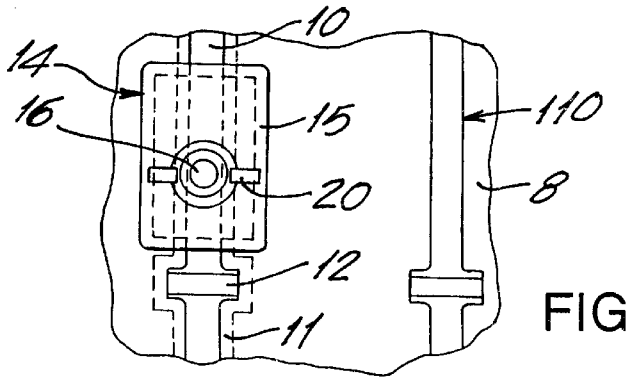
FIG. 5 is a top view of FIG. 4.
Figure 3:
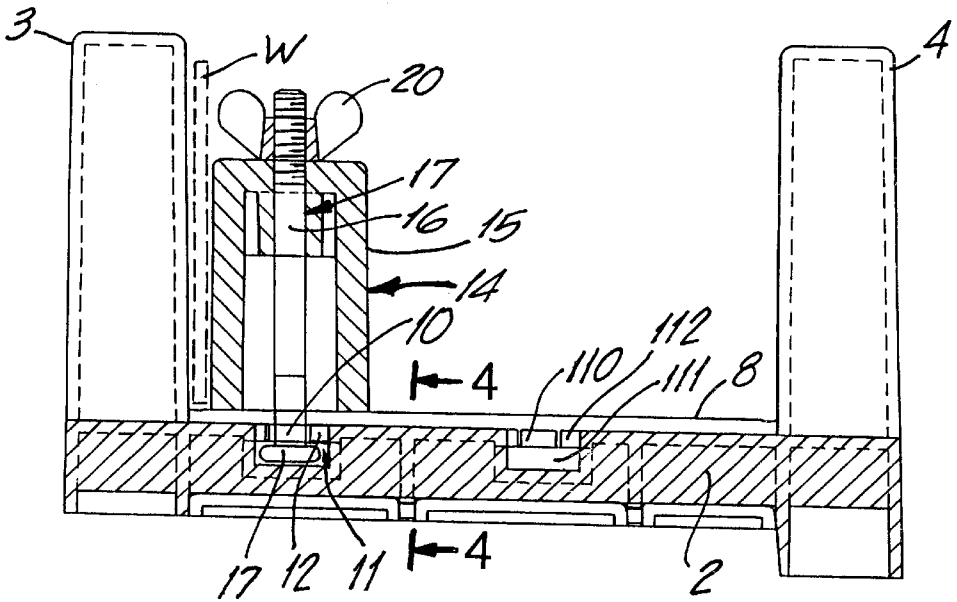
FIG. 3 is a sectional view taken along line 3—3 of FIG. 2.
Figure 4:
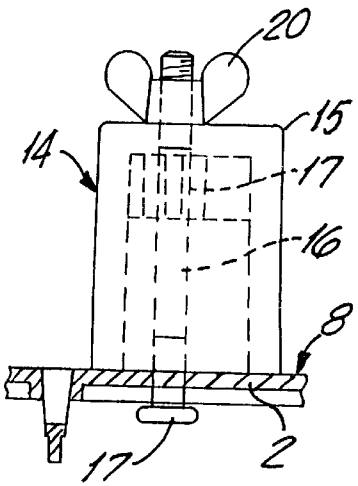
FIG. 4 is a sectional view taken along line 4—4 of FIG. 3.

Referring more particularly to the drawings, the mitre box 1 of the present invention comprises a base 2 and a pair of opposed and spaced upstanding side walls 3 and 4. Each of the upstanding side walls 3 and 4 have a plurality of angled slots 5 and 6 which are complimentary to and coextensive with each other in order to permit a saw blade (not shown) to be inserted in any of the angled slots 5–6 to cut a piece of wood W sitting on the base 2 at the same angle as the angle of the slots 5–6 in which the saw blade is placed to cut. Angled grooves 7 are provided in the base 2 to connect the various angled slots 5–6 with each other so that a saw blade is able to move down to a position beneath the upper surface 8 of the base 2 to cut the wood W (FIG. 3) completely through.

The base 2 is provided with a channel 10 in its upper surface 8 which extends lengthwise of the base 2. The channel 10 has an undercut groove 11 which extends along the entire length of channel 10. The channel 10 is also provided with a plurality of spaced openings 12 to permit access to the undercut groove 11. The channel 10 is preferably formed in two sections 10A and 10B which are joined together at an apex 10C at approximately the center of the base 2 and near to the side wall 3. The sections 10A and 10B radiate outwardly from apex 10C in opposite directions away from the side wall 3 in the direction of outer ends 9 of the base 2. If desired, the channel 10 may be oriented in the reverse manner with the apex 10C furthest from the side wall 3 and the sections 10A and 10B radiating from apex 10C toward side wall 3.

A second channel 110 may also be provided spaced from channel 10 having an apex 110C and sections 110A and 110B oriented in the same direction as channels 10, apex 10C and sections 10A and 10B. This channel 110 may be closer to the opposite side wall 4. An undercut groove 111 is also provided beneath channel 110. The channel 110 is provided with openings 112 to provide access to the undercut groove 111. Preferably the channel 110 is parallel to the channel 10. However, if desired, the channel 110 may be reversed and oriented in the opposite direction to channel 10.

A holding assembly 14 is provided comprising a holding block 15 through which extends a locking element 16 having a guiding head 17 at one end and a threaded portion 18 at it other end. A threaded fastener 20, such as a wing nut, may be threadably mounted on the threaded portion 18. The locking element 16 extends through an opening 19 in the holding block 15 with the guiding head 17 extending from the bottom of the holding block 15 and the threaded portion 18 extending through the top of the holding block 15. The guiding head 17 is inserted into the undercut groove 11 through the openings 12 in the channel 10 and may move along undercut groove 11 to guide the holding block 15 along channel 10. The fastener wing nut 20 when tightened on the threaded portion 18 will hold the holding block 15 down onto the base 2. When the guiding head 17 of the locking element 16 is moved along the undercut groove 11, the holding block 15 is also moved on the base 2 following path of the channel 10 toward and away from the side wall 3. Moving the holding block 15 to a particular position relative to the side wall 3 and tightening the fastener 20 will hold the holding block 15 in place at that position. If a piece of wood W is positioned between the side wall 3 and the holding block 15 (FIG. 3) and the holding block 15 is moved against the wood W and locked in place by fastener 20, the wood W is held steady against the side wall 3 and will not move when the wood W is being cut. When it is decided to release the wood W the fastener 20 is loosened to release the holding block 15 and the holding block 15 is moved along channel 10 away from the wood W and the sidewall 3 thereby releasing the wood W. Since the channel 10 is angled with respect to the side wall 3, the holding block 15 can positioned in any position relative to the side wall 3 thereby permitting the holding block 15 to hold wood W of various lengths and thicknesses against the side wall while it is being cut. Since the channel 10 has two sections 10A and 10B at an angle to each other extending from the apex 10C, the holding block 15 may be moved from a position closer to the side wall 3 to a position further away from the side wall 3 at any point along the side wall 3.

If desired, the channel 10 may be used to accommodate a plurality of holding blocks 15 to If desired, the channel 10 may be used to accommodate a plurality of holding blocks 15 to hold one or more piles of wood W in place. In addition, it is also possible to use the channel 110 at the same time that the channel 10 is being used to hold another piece of wood so that the two pieces of wood may be cut simultaneously. If desired, holding block 15 movable along the channel 10 may be used to hold a thicker piece of wood against the opposite side wall 4. Furthermore, if desired, a holding block may be placed in channel 110 in order to hold a piece of wood against the side wall 4. Alternately, if desired, channel 110 may be used to hold a piece of wood steady against the side wall 3.

Figure 6:
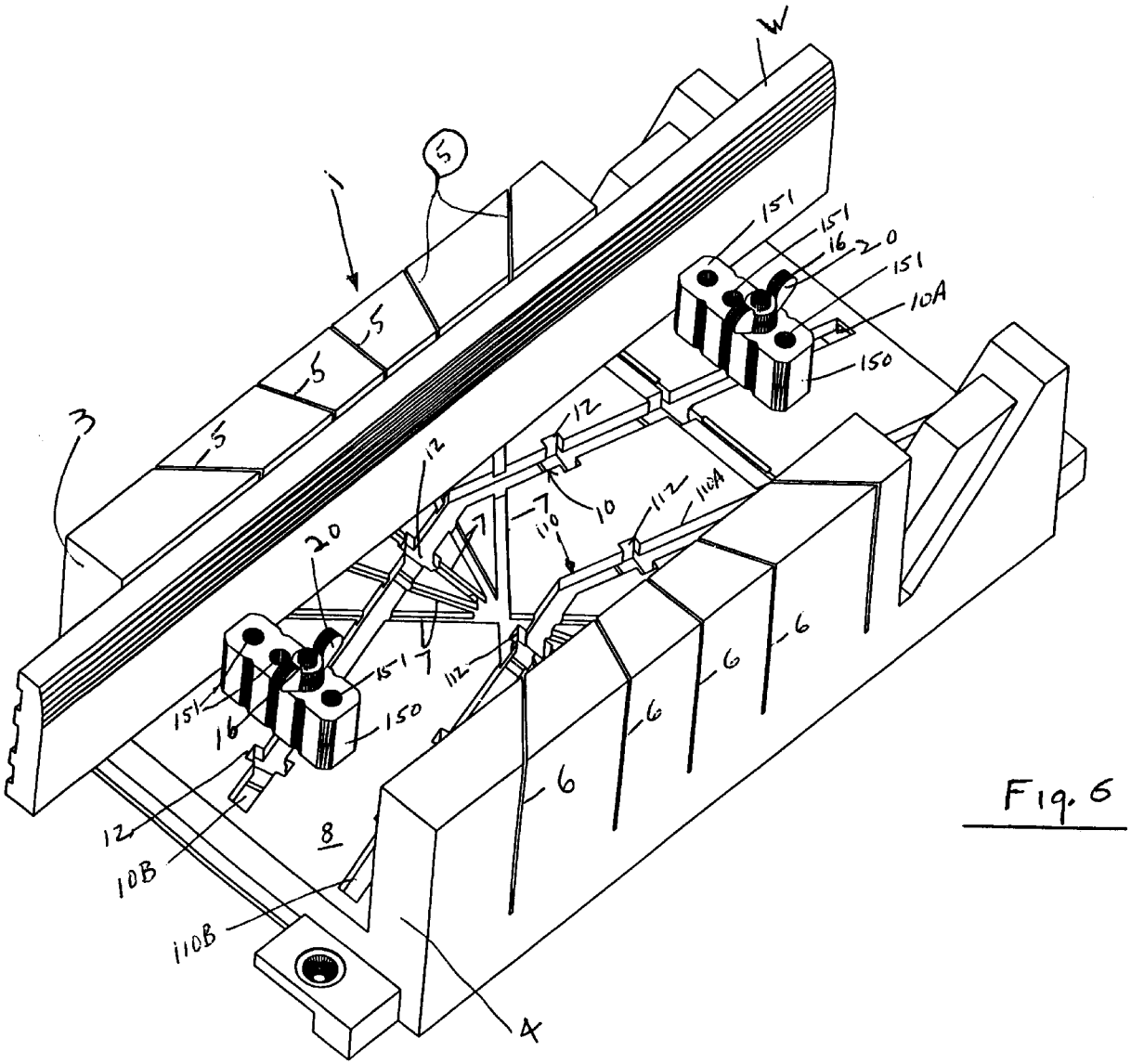
FIG. 6 is a perspective view of another embodiment of the present invention.

Referring more particularly to the embodiment shown in FIG. 6, the holding block shown is an 150 elongated one and has plurality of openings 151 therein. The locking element 16 is adapted to be inserted in any of the openings 151. Hence, in addition to the holding block 150 being able to move toward and away from the wood W by means of the channel 10, the holding block 150 itself can be moved toward and away from the wood W by merely inserting the locking element 16 into one of the openings 151 in the holding block 150. This gives the structure greater flexibility in accommodating woods of different sizes.

It will then be seen that the present invention provides an improved mitre box in which a piece of wood can be cut without any danger of the wood moving and being cut at the wrong angle or the wrong place in which means are provided for holding the wood steady in place which is simple to use and inexpensive to manufacture and maintain.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A mitre box comprising a base and a pair of opposed stationary upstanding side walls, at least one slot in each of said side walls in alignment and coextensive with each other, a channel formed in said base, a holding assembly comprising a locking element said locking element having a guide head extending into the channel, said holding assembly movable along said channel relative to one of said side walls, and said locking element adapted to lock said holding assembly at a predetermined position along said channel and at a predetermined space from said side wall, an undercut groove formed within said base, said undercut groove communicating with said channel, the said guide head being positioned within said undercut groove said channel has an apex close to a side wall and said apex has extending arms radiating away from said side wall.

2. A mitre box as set forth in claim 1 wherein said holding assembly comprises a holding block.

3. A mitre box as set forth in claim 2 wherein said locking element is elongated and wherein said holding block has an opening through which said locking element extends.

4. A mitre box as set forth in claim 3 wherein said guide head extends below said holding block and wherein a portion of the locking element extends above the holding block and fastener means are provided to hold the locking element onto the holding block.

5. A mitre box as set forth in claim 4 wherein said locking element has a threaded portion extended through the top of the holding block and wherein threaded fastener means are provided to be threaded onto said threaded portion.

6. A mitre box as set forth in claim 5 wherein said holding block has a plurality of openings therein.

7. A mitre box as set forth in claim 6 wherein said holding block is elongated.

8. A mitre box as set forth in claim 1 wherein said channel is angled relative to said side wall.

9. A mitre box as set forth in claim 8, wherein an opening is formed in said channel to permit access to the undercut groove.

10. A mitre box as set forth in claim 1, wherein another channel is provided in said base, said other channel being spaced from said first channel and where said other channel has a undercut groove and openings therein to permit access to the undercut groove.

11. A mitre box as set forth in claim 10, wherein said other channel is provided with an apex and arms radiating away from said apex.

12. A mitre box as set forth in claim 11, wherein said radiating arms are parallel to the radiating sections of the first channel.

* * * * *